US005589276A

United States Patent [19]

Roth et al.

[11] Patent Number: 5,589,276

[45] Date of Patent: Dec. 31, 1996

[54] THERMALLY TRANSFERABLE PRINTING RIBBONS AND METHODS OF MAKING SAME

[75] Inventors: Joseph D. Roth, Springboro; Thomas J. Obringer, Vandalia; Monica N. Lewis, Fairborn, all of Ohio

[73] Assignee: NCR Corporation, Dayton, Ohio

[21] Appl. No.: 169,935

[22] Filed: Dec. 20, 1993

[51] Int. Cl.[6] ..... B41M 3/12

[52] U.S. Cl. ..... 428/488.1; 427/146; 427/153; 427/385.5; 428/93

[58] Field of Search ..... 427/146, 153, 427/385.5, 395; 428/488.1, 913

[56] References Cited

U.S. PATENT DOCUMENTS

| | | | |
|---|---|---|---|
| 3,663,278 | 5/1972 | Blose et al. | 117/234 |
| 4,533,596 | 8/1985 | Besselman | 428/341 |
| 4,581,283 | 4/1986 | Tokunaga et al. | 428/216 |
| 4,592,946 | 6/1986 | Shuman | 427/148 |
| 4,628,000 | 12/1986 | Talvalkar et al. | 428/341 |
| 4,818,591 | 4/1989 | Kitamura et al. | 427/146 |
| 4,880,324 | 11/1989 | Sato et al. | 427/488.1 |
| 4,894,283 | 1/1990 | Wehr | 428/341 |
| 4,923,749 | 5/1990 | Talvalkar | 428/341 |
| 4,961,997 | 10/1990 | Asano et al. | 428/423.1 |
| 4,988,563 | 1/1991 | Wehr | 428/341 |
| 5,047,291 | 9/1991 | Talvalkar et al. | 428/329 |
| 5,084,359 | 1/1992 | Talvalkar et al. | 428/484 |
| 5,089,350 | 2/1992 | Talvalkar et al. | 428/484 |
| 5,100,696 | 3/1992 | Talvalkar et al. | 427/130 |
| 5,106,669 | 4/1992 | Talvalkar et al. | 428/195 |
| 5,128,308 | 7/1992 | Talvalkar | 503/201 |
| 5,133,820 | 7/1992 | Katuyama | 427/146 |
| 5,248,652 | 9/1993 | Talvalkar | 503/201 |

*Primary Examiner*—Janyce Bell
*Attorney, Agent, or Firm*—Craig E. Miller

[57] ABSTRACT

Thermally transferable printing ribbons and methods of making same fabricated by initially mixing and grinding solid ingredients together, and then emulsifying the entire mixture. Thermally transferable printing ribbons formulations in accordance with the present invention generally include one or more waxes, one or more resins, and pigments. These ingredients are ground hot in an attritor or ball mill. This mixture is then emulsified, and the resulting formulation is coated on an elongated backing element utilizing conventional coating equipment and techniques.

12 Claims, 1 Drawing Sheet

THERMALLY TRANSFERABLE PRINTING RIBBONS AND METHODS OF MAKING SAME

BACKGROUND AND SUMMARY OF THE INVENTION

The present invention relates generally to new and novel improvements in thermally transferable printing ribbons and methods of making same. More particularly, the present invention relates to thermally transferable printing ribbons and methods of making same which are fabricated by obtaining, mixing and grinding solid ingredients together, and then emulsifying the entire mixture.

The usual method of making aqueous thermally transferable printing ribbons is to first purchase or make the emulsified ingredients, and then to mix the various emulsified ingredients together. A typical pre-emulsified thermally transferable printing ribbon formulation includes one or more emulsified waxes, one or more emulsified resins, and pigments. The pre-emulsified ingredients are mixed with the pigments, and then the resultant mixture is ground in an attritor or ball mill. The resulting formulation is then coated onto an elongated backing element.

Mixing pre-emulsified ingredients together results in a formulation containing discrete particles of wax, particles of resin, and particles of pigment suspended in water. All of these components are solids and have very little opportunity to interact with each other. This inability for ingredients to mix and interact with each other results in several undesirable consequences for thermally transferable printing ribbon formulations.

First, during the grinding of pre-emulsified thermally transferable printing ribbon formulation components, the solid resin particles cannot act as dispersants for the pigment. Resins must be in a liquid form to interact with pigments. This results in a low color density for printed images and characters.

Second, emulsions consist of particles suspended in water. Once the water is removed, the particles remain. The mixing of two or more emulsions results in two or more distinct types of particles, resulting in non-uniform coating on the elongated backing element and physical separation of the ingredients from each other on the elongated backing element.

Accordingly, an object of the present invention is the provision of thermally transferable printing ribbons and methods of making same which provides a more uniform mixing and distribution of the solid ingredients in the thermally transferable printing media layer.

Another object of the present invention is to provide thermally transferable printing ribbons and methods of making same which provide printed images and characters having enhanced color density.

These and other objects of the present invention are attained by the provision of thermally transferable printing ribbons and methods of making same fabricated by initially mixing and grinding solid ingredients together, and then emulsifying the entire mixture. Thermally transferable printing ribbons formulations in accordance with the present invention generally include one or more waxes, one or more resins, and pigments. These ingredients are ground hot in an attritor or ball mill. This mixture is then emulsified, and the resulting formulation is coated on an elongated backing element utilizing conventional coating equipment and techniques.

Other objects, advantages and novel features of the present invention will become apparent in the following detailed description of the invention when considered in conjunction with the accompanying drawings.

DETAILED DESCRIPTION OF THE DRAWINGS

Figure 1:
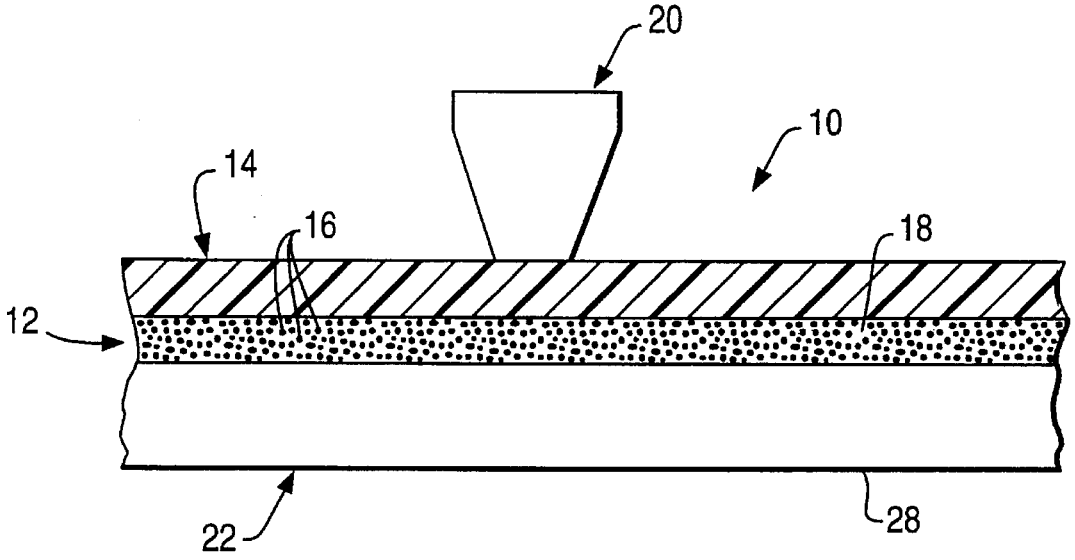
FIG. 1 is a cross-sectional side view of a preferred embodiment of a thermally transferable printing ribbon showing a conventional thermal transfer print head transferring a thermally transferred printed image or character from the thermally transferable printing ribbon to a print receiving medium in accordance with the present invention.
Figure 2:
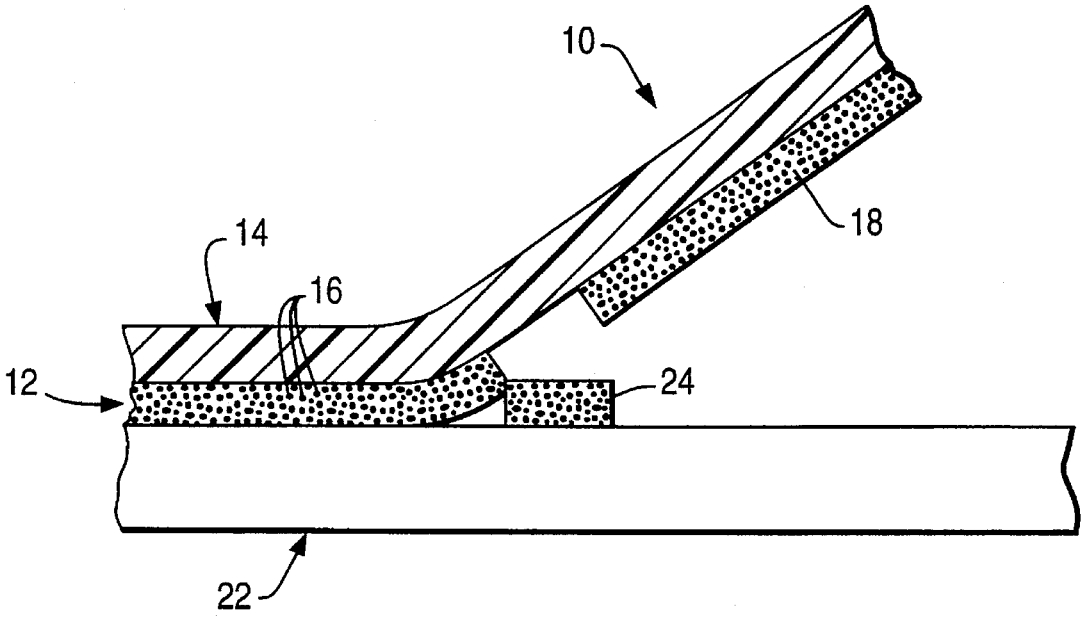
FIG. 2 is a cross-sectional side view of the thermally transferred printed image or character formed from the preferred embodiment of thermally transferable printing ribbon shown in FIG. 1, fixed upon the print receiving medium.

Referring now to the drawings, in which like-referenced characters indicate corresponding elements throughout the several views, attention is first drawn to FIGS. 1 and 2 which illustrate a first preferred embodiment of a thermally transferable printing ribbon in accordance with the present invention, generally identified by reference numeral 10. Thermally transferable printing ribbon 10 consists of thermally transferable printing media layer 12 which is adhered to one side of elongated backing element 14. Elongated backing element 14 is preferably a long narrow strip of a flexible polymeric material, most preferably a polyester film such as Mylar, available from E. I. Dupont de Nemours & Co., Incorporated in Wilmington, Del. Elongated backing element 14 should be compatible with thermally transferable printing media layer 12, and preferably has sufficient tensile strength to resist tearing, while being sufficiently flexible to be wound around a spool or reel.

In the preferred embodiment shown, thermally transferable printing media layer 12 includes a uniform interspersed distribution of visible black or colored pigments or inks 16 retained in binding substrate 18. Visible black or colored pigments or inks 16 most preferably include carbon black pigments or black ink, but could also include visible green, brown, blue and other colored pigments or inks, as desired. In addition, it will be recognized by those skilled in the relevant art that other pigments or inks could be substituted, or added, to visible black or colored pigments or inks 16 in binding substrate 18. For example, magnetic identification character recognition (MICR) pigments or inks could be added to allow automated machine reading of the thermally transferred printed images or characters. In addition, fluorescent pigments or inks could be added, or substituted, for visible black or colored pigments or inks 16 to permit "security" markings or thermally transferred printed images or characters which fluoresce, or become visible when exposed to light having wavelengths in the ultraviolet spectrum. It should be recognized that various combinations of these pigments and inks could be selected, as desired, to provide thermally transferred printed images and characters having the desired characteristics.

Binding substrate 18 retains the uniform interspersed distribution of visible black or colored pigments or inks 16 against elongated backing element 14 prior to the thermal transfer printing operation. In addition, binding substrate 18 retains the uniform interspersed distribution of visible black or colored pigments or inks 16 once thermally transferable printing media layer 12 is transferred onto paper or some other print receiving medium.

To fabricate thermally transferable printing ribbon 10, solid ingredients including one or more waxes, one or more resins, and pigments are ground together hot in a attritor or ball mill. This mixture is then emulsified and the resulting formulation is coated onto elongated backing element 14 using conventional coating equipment and techniques.

Referring again to FIGS. 1 and 2, the use of thermally transferable printing ribbon 10 in the thermal transfer printing operation will now be described. As seen in FIG. 1, conventional thermal transfer print head, shown schematically as reference numeral 20, is placed in contact with elongated backing element 14 with thermally transferable printing media layer 12 facing and in contact with print receiving medium 22, for example paper. Portions of thermal transfer print head 20 corresponding to the desired thermally transferred printed image or character 24 are then heated, typically by passing an electrical current through selective resistive elements. This heating is continued until the temperature of binding substrate 18 is above its melting point in those portions corresponding to the desired thermally transferred printed image or character 24. These portions of thermally transferable printing media layer 12 are then transferred onto the adjacent surface of print receiving medium 22, where binding substrate 18 again solidifies. During this transfer operation, binding substrate 18 carries along the interspersed distribution of visible black or colored pigments or inks 16, which remain retained in binding substrate 18, onto print receiving medium 22. As seen in FIG. 2, once binding substrate 18 has solidified on print receiving medium 22, thermal transfer print head 20 is moved away and elongated backing element 14 is pulled away and separates from thermally transferable printing media layer 12 in those portions corresponding to the desired thermally transferred printed image or character 24. At this time, thermally transferred printed image or character 24 is fixed on print receiving medium 22.

Although the present invention has been described above in detail, the same is by way of illustration and example only and is not to be taken as a limitation on the present invention. For example, although the use of a single-layer thermally transferable printing media layer 12 has been described herein, the use of two, or more, thermally transferable printing media layers could be readily accomplished utilizing the teachings of the present invention. Accordingly, the scope and content of the present invention are to be defined only by the terms of the appended claims.

What is claimed is:

1. A method of making thermally transferable printing ribbons, comprising the steps of:

mixing at least one wax, at least one resin and pigments together to form a mixture of solids;

grinding said mixture of solids to form a resultant mixture;

emulsifying said resultant mixture to form an emulsified thermally transferable printing media layer formulation; and coating said emulsified thermally transferable printing media layer formulation onto an elongated backing element in a single layer to form said thermally transferable printing ribbons.

2. The method of making thermally transferable printing ribbons in accordance with claim 1, wherein said step of grinding said mixture of solids to form a resultant mixture is carried out at an elevated temperature.

3. The method of making thermally transferable printing ribbons in accordance with claim 2, wherein said step of grinding said mixture of solids to form a resultant mixture is carried out in an attritor.

4. The method of making thermally transferable printing ribbons in accordance with claim 2, wherein said step of grinding said mixture of solids to form a resultant mixture is carried out in a ball mill.

5. The method of making thermally transferable printing ribbons in accordance with claim 1, wherein said step of grinding said mixture of solids to form a resultant mixture is carried out in an attritor.

6. The method of making thermally transferable printing ribbons in accordance with claim 1, wherein said step of grinding said mixture of solids to form a resultant mixture is carried out in a ball mill.

7. The method of making thermally transferable printing ribbons in accordance with claim 1, wherein said pigment includes carbon black.

8. A thermally transferable printing ribbon fabricated using the method of making thermally transferable printing ribbons in accordance with claim 1.

9. A method of making thermally transferable printing ribbons comprising the steps of:

mixing at least one wax, at least one resin and at least one pigment together to form a mixture of solids;

grinding said mixture of solids at a temperature greater than room temperature to form a resultant mixture;

emulsifying said resultant mixture to form an emulsified thermally transferable printing ribbon formulation; and coating said emulsified thermally transferable printing ribbon formulation onto an elongated backing element in a single layer.

10. The method of making thermally transferable printing ribbons in accordance with claim 9, wherein said step of grinding said mixture of solids to form a resultant mixture is carried out in an attritor.

11. The method of making thermally transferable printing ribbons in accordance with claim 9, wherein said step of grinding said mixture of solids to form a resultant mixture is carried out in a ball mill.

12. A thermally transferable printing ribbon fabricated using the method of making thermally transferable printing ribbons in accordance with claim 9.

* * * * *